United States Patent [19]

Scott et al.

[11] 4,260,326

[45] Apr. 7, 1981

[54] BLADE FOR A GAS TURBINE ENGINE

[75] Inventors: Alexander Scott; Roy Simmons, both of Bristol, England

[73] Assignee: Rolls-Royce Limited, London, England

[21] Appl. No.: 489,151

[22] Filed: Jul. 18, 1974

[30] Foreign Application Priority Data

Jul. 26, 1973 [GB] United Kingdom ..... 35579/73

[51] Int. Cl.[3] ..... F01D 5/18; F01D 9/02

[52] U.S. Cl. ..... 415/115; 415/137; 415/200

[58] Field of Search ..... 416/232, 97 RA, 132 R, 416/225, 95; 415/115

[56] References Cited

U.S. PATENT DOCUMENTS

| | | | |
|---|---|---|---|
| 2,254,821 | 9/1941 | Haw | 416/225 |
| 3,301,526 | 1/1967 | Chamberlain | 415/115 |
| 3,353,359 | 11/1967 | Webb | 60/265 |
| 3,378,228 | 4/1968 | Davies et al. | 416/225 |

*Primary Examiner*—Stephen C. Bentley

*Attorney, Agent, or Firm*—Cushman, Darby & Cushman

[57] ABSTRACT

A stator blade for a gas turbine engine comprises a stack of laminar sections and means adapted to resiliently hold the sections together in compression to allow for differential expansion between the stack and supporting structure.

8 Claims, 4 Drawing Figures

BLADE FOR A GAS TURBINE ENGINE

This invention relates to a stator blade for a gas turbine engine.

Throughout the following specification the term blade is to be understood to include stator blades and vanes.

One of the ways in which the efficiency of a gas turbine engine may be increased is to increase the temperature to which the gases are raised in the combustion system. However, any such increase in temperature requires that the components immediately downstream of the combustion system withstand higher temperatures, and there is consequently a continual search for materials which will withstand high temperatures. Many of the materials which are resistant to high temperatures, such for instance as the ceramic materials, possess the disadvantage that they are brittle or have other undesirable mechanical properties and special ways must be found to construct and locate components of these materials.

One construction for these materials involves the use of a plurality of sections in the form of a stack to make up a blade or vane; such a construction is described in British Pat. No. 1,075,910. However, this construction has the disadvantage that the sections themselves are likely to be of low coefficient of expansion while the tie bolt which holds the sections together is likely to be of high coefficient of expansion, consequently allowing the sections freedom to move when the assembly is at high temperature.

The present invention provides a blade which overcomes the above problem. According to the present invention a blade for a gas turbine engine comprises a stack of laminar sections, and means adapted in operation to resiliently hold said sections together in compression.

Said laminar sections may comprise hollow sections which embrace a structural core.

Said sections may be retained on said core by rigidly fixed end abutments, and said resilient means may be additional to the abutments.

Said resilient means may comprise means for causing pressurised air from a part of the engine to act on the sections to compress them against one said end abutment. Thus said pressurised air may act on a piston and cylinder device said piston being connected to one end of said stack of sections to compress the stack against the opposite end abutment.

Figure 1:
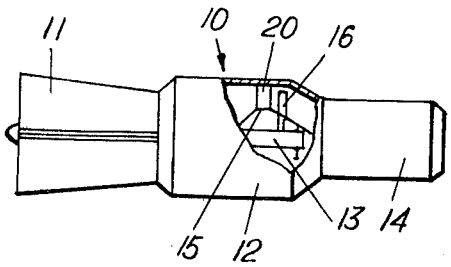
Figure 2:
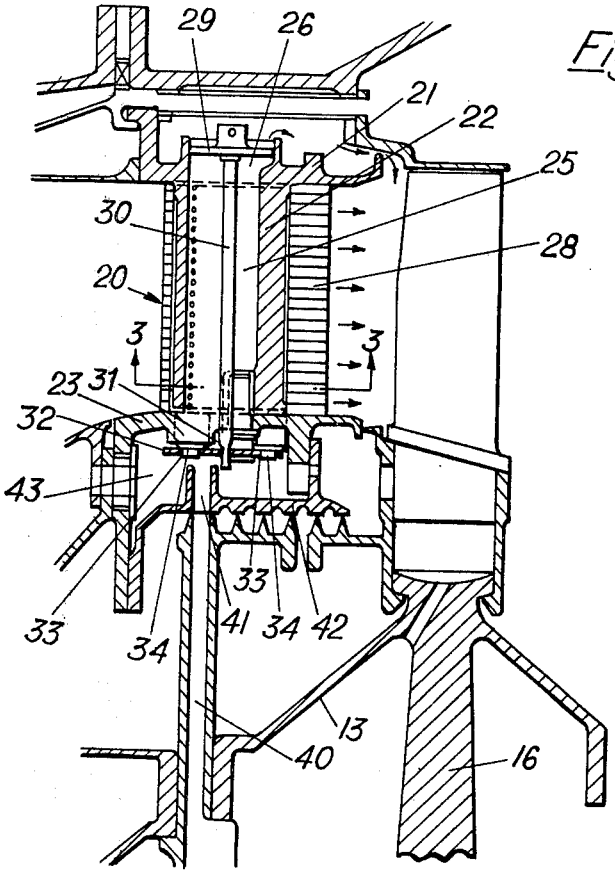
Figure 3:
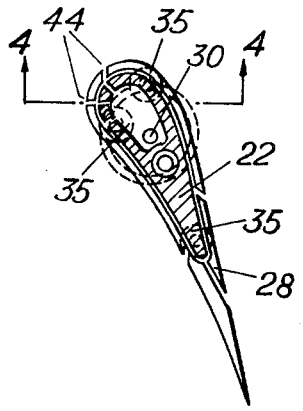
Figure 4:
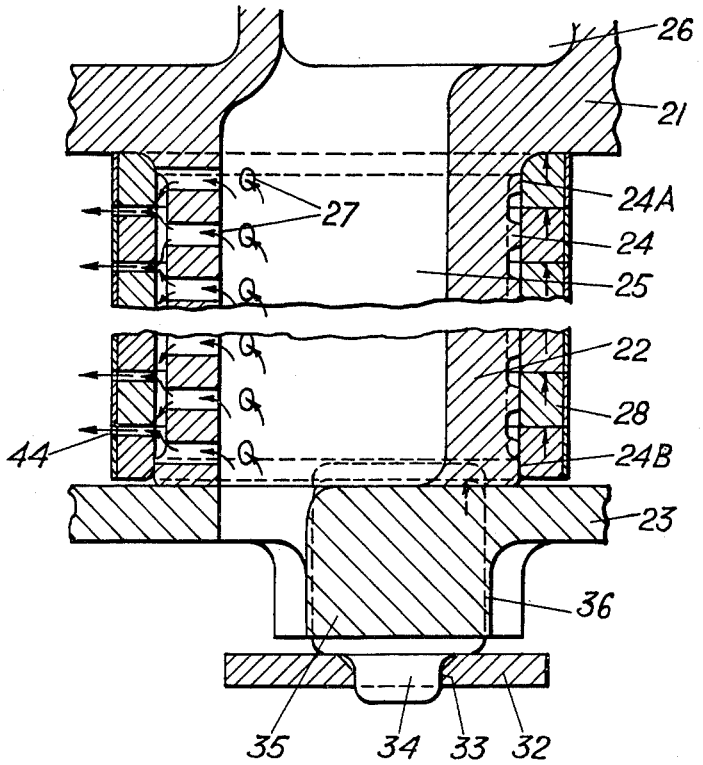

The invention will now be particularly described, merely by way of example, with reference to the accompanying drawings in which:

FIG. 1 is a partly broken away diagrammatic view of a gas turbine engine having blades in accordance with the invention, FIG. 2 is an enlarged sectional view of the nozzle guide vane of the engine of FIG. 1 and in accordance with the invention, FIG. 3 is a section on the line 3—3 of FIG. 2, and FIG. 4 is an enlarged section on the line 4—4 of FIG. 3.

FIG. 1 shows a gas turbine engine 10 having a compressor 11, combustion equipment 12, a turbine 13 and a jet pipe 14 all in flow series. The portion cut away in FIG. 1 shows diagrammatically part of an annular nozzle 15 at the downstream end of the combustion equipment 12 and upstream of a turbine rotor stage 16.

Mounted in the nozzle 15 is a plurality of angularly spaced apart nozzle guide vanes 20 which extend substantially radially across the nozzle 15 and which serve to guide the hot combustion gases from the combustion equipment 12 into the turbine 13.

The construction of the nozzle guide vane 20 in accordance with the present invention is illustrated in FIGS. 2, 3 and 4. Each guide vane 20 comprises an outer end abutment 21, which forms part of the outer shroud ring of an annulus of the vanes 20, and a core 22 formed integrally with the abutment 21 and extending substantially radially inward with respect to the annular nozzle 15. To the radially inner extremity of the core 22 is bolted an inner end abutment 23; in a similar fashion to the outer abutment 21 this forms part of a complete annular inner shroud ring.

As can best be seen from FIG. 3, the core 22 is of substantially aerofoil cross-section, and it will be seen from FIG. 4 that the outer surface of the core has arrays of small projections or 'pimples' 24 from its outer surface. The core is also hollow, with a central bore 25 which opens out at its outer extremity to form a cylindrical chamber 26. From the bore 25 rows of drillings 27 extend to the outer surface of the core.

The aerofoil surface of the vane itself is made up of a stack of laminar sections 28. In this particular embodiment the sections 28 are made of hot pressed silicon nitride with an outer coating of chemical vapour deposited silicon nitride to form the actual aerofoil surface. The sections are shaped so that their inner surfaces are of the same shape as the figure defined by the outer extremities of the projections 24; the outer surfaces of each section is of an aerofoil shape to make up a laminar section of the desired vane shape.

A plurality of the sections 28 are mounted from the core 22 in a stack so that each section embraces the core and is held in position by engagement with the extremities of the projections 24. Adjacent the abutments 21,23 the core has projections 24A,24B (FIG. 4) which are peripherally continuous so as to seal the space between the sections and the core against the combustion products surrounding the vane. The stack of sections is prevented from sliding off the core in an axial direction by the end abutments 21 and 23. However, it will be appreciated that differential expansion of the core and the sections could leave the sections with axial freedom and consequently could allow chatter and damage of the brittle sections.

To avoid this possibility the cylindrical chamber 26 is provided with a piston 29 which is a sliding fit in the chamber. A piston rod 30 extends through the bore 25 and is enlarged at its inner extremity 31 to engage with a plate 32. The plate 32 is provided with three holes 33 within which engage projections 34 from silicon nitride buttons 35. Each button 35 is retained in a drilling 36 in the inner end abutment 23 and extends therethrough to bear on the lowermost of the stack of sections 28. The core 22 is cut away where necessary to allow the buttons 35 limited freedom of axial movement, and the buttons are spaced so that two bear on the section adjacent to the leading edge while one bears on both flank portions of the trailing edge part of the section.

To provide the required air at sufficiently high pressure to provide cooling, and to cause the buttons to bear on the sections, a centrifugal pump 40 is provided as an integral part of the shaft 13 of the turbine 16. This pump takes air from the inside of the shaft and centrifuges it out through the shaft to a diffuser ring 41 formed in fixed structure 42 which is retained to the shroud ring formed by the abutments 23 to form an annular plenum chamber 43 which communicates with the bores 25 of the cores 22.

Operation of the construction is as follows. The length of the core 22 and the thickness of the sections 28 are arranged so that when cold, the stack of sections 28 has only a very slight axial clearance between the abutments 21,23. When the engine starts to operate, the shaft 13 will rotate, causing the pump 40 to provide a flow of air to the diffuser ring 41 in which the dynamic head of the air is converted to a high static pressure in the plenum chamber 43. This high air pressure communicates via the bore 25 with the cylinder 26 and acts upon the piston 29 to push it outwardly.

The piston 29 acts through the rod 30 and the plate 32 to push the buttons 35 in an outward direction and hence to compress the stack of sections 38 against the outer end abutment 21. Hence although the core 22 and the piston rod 30 may well expand to a greater degree than the stack of sections 28, the piston 29 will be pushed outwardly at all times when the engine operates to a position in which it compresses the stack of sections together and takes up any clearance between them. This will cause the appearance of a gap between the innermost section 28 and the abutment 23; however the drillings 27 will allow the high pressure air from the bore 25 to escape into the space between the sections 28 and the core, and this air will pressurise the seal formed at the projections 24A,24B, thereby preventing the ingress of hot gases and maintaining the integrity of the vane.

It will also be understood that the high pressure air which flows into the space between the sections and the core provides some impingement cooling of the sections and could further be used for film cooling; thus in particular the one or both of the abutting surfaces of the adjacent sections could be provided with grooves which form channels in the completed blade through which this air may pass to provide film cooling of the blade surface. These grooves are visible at 44 in FIGS. 3 and 4 of the accompanying drawings.

It should be noted that although the above embodiment describes silicon nitride sections which are held together by air pressure used in a particular way, a number of alternatives are possible. Thus the same principle could be used with sections of any suitable high temperature resistant material, while the method used to provide the resilient loading could comprise a simple spring, or an air pressure device acting directly on the inner section, or other suitable devices.

We claim:

1. A stator blade for a gas turbine engine, comprising laminar sections arranged in abutting relationship and defining a stack having opposite ends, fixed structure confronting one end of the stack, and a piston and cylinder device connected between the fixed structure and the other end of the stack for compression thereof under air pressure supplied to said piston and cylinder device.

2. A stator blade as claimed in claim 1 in which said sections are hollow and define an opening extending through the stack between the ends thereof, and including a pressure member situated at said other end of the stack, said piston and cylinder device having a cylinder situated adjacent said one end of the stack and containing a piston, and a tension member connected between the pressure member and the piston.

3. A stator blade as claimed in claim 2 in which said fixed structure includes means defining an inlet for pressurized cooling air adjacent said other end of said stack and connected to the opening in said stack for the supply of cooling air thereto, and means provided adjacent the other end of said stack for ducting the cooling air from the opening in said stack into said cylinder for actuation of said piston.

4. A stator blade as claimed in claim 2 comprising a core extending within said opening and having exterior surfaces for the support of the sections in their stacked relationship, an enlarged portion of the core extending beyond said one end of the stack and including the said cylinder, means defining an opening within the core in the direction of the length of the stack, and said tension member extending through the opening in the core.

5. A stator blade as claimed in claim 4 comprising means defining ducts in the core between the interior thereof and the opening in the stack for the supply of cooling air from the interior of the core to the sections.

6. A stator blade according to claim 1 in which adjacent sections define two abutting surfaces, at least one groove in one of the abutting surfaces extending between the interior and exterior of the hollow section defining together with the other abutting surface at least one channel for the supply of cooling air from the opening in the stack to the exterior thereof.

7. A stator blade as claimed in claim 1 and in which said sections are made of a ceramic material.

8. A stator blade as claimed in claim 7 and in which there is a structural core which is made of metal.

* * * * *